US009643309B2

(12) United States Patent
Schnell et al.

(10) Patent No.: US 9,643,309 B2
(45) Date of Patent: May 9, 2017

(54) PORTABLE MACHINE TOOL SWITCHING UNIT

(75) Inventors: Pascal Schnell, Baerschwil (CH); Pasquale Oliverio, Erlinsbach (CH); David Muff, Hildisrieden (CH)

(73) Assignee: Robert Bosch GmbH, Stuttgart (DE)

( * ) Notice: Subject to any disclaimer, the term of this patent is extended or adjusted under 35 U.S.C. 154(b) by 1202 days.

(21) Appl. No.: 13/390,467

(22) PCT Filed: Jul. 6, 2010

(86) PCT No.: PCT/EP2010/059601

§ 371 (c)(1),
(2), (4) Date: May 25, 2012

(87) PCT Pub. No.: WO2011/020644

PCT Pub. Date: Feb. 24, 2011

(65) Prior Publication Data

US 2012/0234568 A1 Sep. 20, 2012

(30) Foreign Application Priority Data

Aug. 18, 2009 (DE) ..... 10 2009 028 622

(51) Int. Cl.
*B25D 16/00* (2006.01)
*B25F 5/00* (2006.01)

(52) U.S. Cl.
CPC ..... *B25D 16/003* (2013.01); *B25F 5/001* (2013.01); *B25D 2250/255* (2013.01); *B25D 2250/371* (2013.01)

(58) Field of Classification Search
CPC ..... G05G 1/08
USPC ..... 173/170; 74/473.37
See application file for complete search history.

(56) References Cited

U.S. PATENT DOCUMENTS

| | | | | |
|---|---|---|---|---|
| 2003/0079562 | A1* | 5/2003 | Schaible et al. | 74/473.37 |
| 2007/0209815 | A1* | 9/2007 | Iwakami et al. | 173/48 |
| 2010/0096153 | A1* | 4/2010 | Ullrich et al. | 173/47 |
| 2010/0218965 | A1* | 9/2010 | Guenther | 173/48 |

FOREIGN PATENT DOCUMENTS

| | | | | |
|---|---|---|---|---|
| CN | 1404431 | A | 3/2003 | |
| CN | 1817569 | A | 8/2006 | |
| DE | 10 2007 009 986 | A1 | 9/2008 | |
| EP | 0 437 716 | A1 | 7/1991 | |
| EP | 0836902 | A1 * | 4/1998 | B23B 45/008 |
| EP | 1 259 357 | A1 | 11/2002 | |
| EP | 2 181 812 | A2 | 5/2010 | |

(Continued)

OTHER PUBLICATIONS

International Search Report corresponding to PCT Application No. PCT/EP2010/059601, mailed Oct. 21, 2010 (German and English language document) (5 pages).

*Primary Examiner* — Hemant M Desai
*Assistant Examiner* — Mary Hibbert
(74) *Attorney, Agent, or Firm* — Maginot, Moore & Beck LLP

(57) ABSTRACT

A portable machine tool switching unit includes a turning knob unit, which has a coupling unit that can be rotatably driven for coupling to at least one switching element, and further includes at least one energy storage element provided for storing switching energy in the case of a preselection. The energy storage element is integrated in the turning knob unit.

17 Claims, 8 Drawing Sheets

(56) References Cited

FOREIGN PATENT DOCUMENTS

| | | |
|---|---|---|
| RU | 2 174 895 C2 | 10/2001 |
| WO | 93/15863 | 8/1993 |
| WO | 96/15863 | 5/1996 |

* cited by examiner

Fig. 8
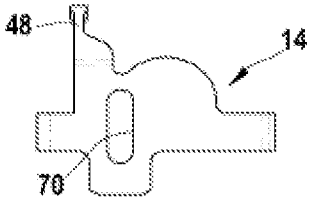
Fig. 9
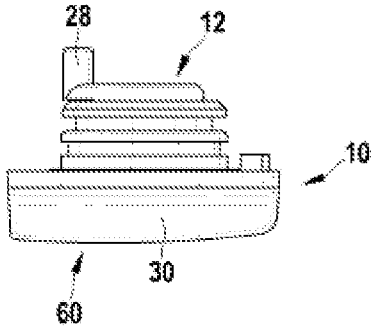
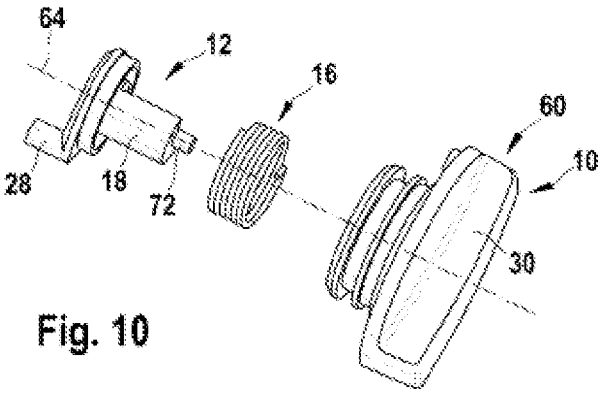
Fig. 10

PORTABLE MACHINE TOOL SWITCHING UNIT

This application is a 35 U.S.C. §371 National Stage Application of PCT/EP2010/059601, filed on Jul. 6, 2010, which claims the benefit of priority to Serial No. DE 10 2009 028 622.5, filed on Aug. 18, 2009 in Germany, the disclosures of which are incorporated herein by reference in their entirety.

BACKGROUND

The disclosure proceeds from a portable machine tool switching unit as described herein.

EP 1 259 357 B1 discloses a portable machine tool with a portable machine tool switching unit having a rotary knob unit which has a rotationally drivable coupling unit, formed by a gearwheel, for coupling to a switching element formed by a rack. The portable machine tool switching unit has an energy accumulator element which is formed by a spring bar and which is provided for the storage of switching energy in the event of preselection. The energy accumulator element is arranged between the first rack and a switchfork which engages into a clutch of a draw key transmission of the portable machine tool.

SUMMARY

The disclosure proceeds from a portable machine tool switching unit having a rotary knob unit, which has a rotationally drivable coupling unit for coupling to at least one switching element, and having at least one energy accumulator element, which is provided for the storage of switching energy in the event of preselection.

It is proposed that the energy accumulator element be integrated in the rotary knob unit. In this case, "rotationally drivable coupling unit of the rotary knob unit" is to be understood, in particular, as meaning a unit which, in at least one operating mode, is driven at least partially and preferably completely in rotation about at least one axis for switching a transmission gear, in particular by an operator and/or the energy accumulator element, and which at the same time executes a rotational movement about the axis, the coupling unit being provided particularly for the direct contacting of the switching element. Preferably, the coupling unit also forms, in particular, part of a transmission which is provided for converting a rotational movement into another type of movement, in particular into a translational switching movement. The term "provided" is to be understood especially as meaning equipped and/or designed. The term "preselection" is to be understood, in particular, as meaning that an operator can select a transmission gear in a selection operation, and the transmission gear is switched in a switching operation, in particular with a time offset, in particular at least partially automatically, specifically, in particular, when a tooth-on-tooth position is cancelled. An "energy accumulator element" is to be understood, in particular, as meaning an element which is provided in a directed manner for storing energy, in particular kinetic energy during a selection operation, in another form of energy, such as pressure energy, chemical energy and preferably mechanical tension energy, and for discharging said energy again after the selection operation during a switching operation. Furthermore, "integrated" is to be understood, in particular, to mean that the energy accumulator element is arranged in the force flux between two elements of the rotary knob unit, specifically preferably between a grip element of the rotary knob unit and the coupling unit, and/or, in particular, is arranged at least partially inside a grip element of the rotary knob unit. A simple and compact type of construction can be achieved by means of a corresponding configuration. Furthermore, components and weight can be saved and the outlay in terms of assembly can be reduced.

The energy accumulator element may be formed by various elements which appear expedient to a person skilled in the art, such as by a gas pressure accumulator, a hydraulic pressure accumulator, etc., but especially advantageously by a mechanical spring element which is designed to be deflected elastically during a selection operation. Especially advantageously, the energy accumulator element has in this case at least one leg spring or is designed as a leg spring. In this context, a "leg spring" is to be understood, in particular, to mean a spring which has at least one leg which is provided for being deflected in the circumferential direction of a rotational movement, in particular about a helical axis of a helical spring, or for being deflected during a selection operation. A corresponding spring can be integrated in an especially space-saving way and, in particular, high elastic deflection and therefore a long switching travel after a selection operation can be implemented in a simple way, specifically, in particular, when the leg spring extends over at least 180° and especially preferably over more than 360° about at least one rotationally drivable shaft of the rotary knob unit.

If the energy accumulator element is arranged in the force flux between a first rotationally drivable shaft of the rotary knob unit and a second rotationally drivable shaft of the rotary knob unit, once again construction space can advantageously be saved, specifically, in particular, when the first shaft is arranged at least partially in the second shaft, with the result that advantageous mounting can also be achieved.

In a further refinement of the disclosure, it is proposed that at least one of the shafts have a recess which extends in the circumferential direction of the shaft over an angular range greater than 30° and preferably greater than 60°, with the result that advantageously simple coupling of the energy accumulator element to the shaft can be achieved, specifically, especially preferably, in a configuration of the energy accumulator element as a leg spring.

Furthermore, it is proposed that at least one of the shafts be formed in one piece with an output element of the rotary knob unit. In this context, an output element is to be understood as meaning, in particular, an element of the coupling unit which is coupled, that is to say contacted, directly with an adjacent switching element, and/or an element which is provided for being contacted directly by an operator during a selection operation, such as, in particular, a grip element of the rotary knob unit. Additional components, weight, outlay in terms of assembly and costs can be saved by means of a corresponding configuration.

If the energy accumulator element has at least one spring element prestressed in a switching position, undesirable movements and, in particular, excitations to vibration can advantageously be prevented, and, in particular, the coupling unit and a grip unit can be positioned exactly in relation to one another in an unequivocal position. In this context, a "switching position" is to be understood, in particular, to mean a position in which a transmission gear is switched. Preferably, in this case, an operating frequency of a portable machine tool comprising the portable machine tool switching device is lower than a characteristic frequency of the spring element.

The coupling unit may have various elements which appear expedient to a person skilled in the art, such as, for example, a gearwheel and/or preferably an eccentric element, with the result that a structurally simple transmission for converting a rotational movement into an axial switching movement can be achieved. Furthermore, advantageous vibrational decoupling of the energy accumulator element can be achieved in at least individual directions. Preferably, in a portable machine tool with a percussion unit, such as in a percussion drilling machine, a hammer drill and/or a chisel hammer, in at least one switching position, an eccentric element is arranged in a reversal position along a pulse axis along which a pulse acts upon an insertion tool inserted into the portable machine tool, with the result that the energy accumulator unit can be decoupled from vibrations especially advantageously along the pulse axis.

If the portable machine tool switching unit has at least one mechanical stop for driving the coupling unit, a reliable movement of the coupling unit can be ensured, even when a drive force rises above a specific amount, such as, for example, in the event of jamming. The stop is in this case preferably configured in such a way that the energy accumulator element can be at least partially bridged, that is to say at least part of the energy accumulator element is removed from the force flux when the stop comes to bear.

The portable machine tool switching unit according to the disclosure can be used in various portable machine tools which appear expedient to a person skilled in the art, but especially advantageously in portable machine tools which have a sliding gear transmission, specifically, in particular, on account of the possibility of space-saving integration and/or the long switching travel which can be implemented in a simple way after a selection operation. In this context, a "sliding gear transmission" is to be understood, in particular, to mean a transmission in which a gearwheel, in particular a spur gearwheel is displaced during a switching operation.

BRIEF DESCRIPTION OF THE DRAWINGS

Further advantages may be gathered from the following drawing description. An exemplary embodiment of the disclosure is illustrated in the drawing. The drawing, description and claims contain numerous features in combination. A person skilled in the art will also appropriately consider the features individually and combine them into expedient further combinations.

In the drawing:

FIG. 8 shows an adjusting slide illustrated individually, FIG. 9 shows a rotary knob unit of the portable machine tool in a side view, FIG. 10 shows an exploded illustration of the rotary knob unit.

DETAILED DESCRIPTION

Figure 1:
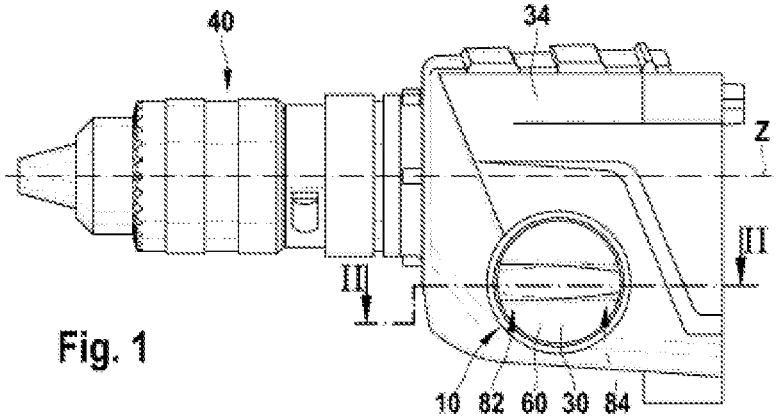
FIG. 1 shows a detail of a portable machine tool.
Figure 6:
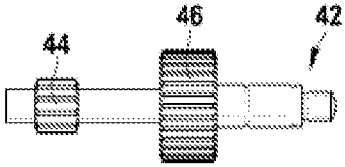
FIG. 6 shows an intermediate shaft with gearwheels illustrated individually.
Figure 7:
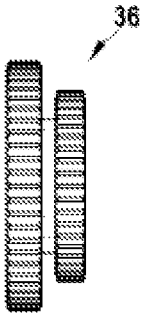
FIG. 7 shows a double spur wheel illustrated individually.
Figure 11:
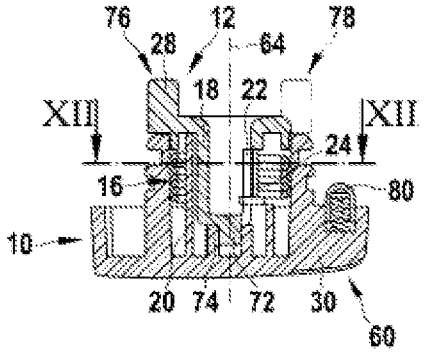
FIG. 11 shows a sectional illustration of the rotary knob unit along line II-II in FIG. 1.

FIG. 1 shows a detail of a portable machine tool, specifically a percussion drilling machine, with a switching transmission (FIGS. 1 to 8) formed by a sliding gear transmission 32. The sliding gear transmission 32 is arranged in a transmission housing 34 of the portable machine tool and has a double spur wheel 36 with two spur wheels which are connected fixedly to one another and which have different diameters and are mounted on a working spindle 38 fixedly in terms of rotation and so as to be displaceable jointly in the direction of a Z-axis (FIGS. 3, 4 and 7). The working spindle 38 is designed as a splined shaft and is directly connected fixedly in terms of rotation to a tool chuck 40 of the portable machine tool. By the double spur wheel 36 being displaced in the direction of the Z-axis, the spur wheels of the latter can be coupled to gearwheels 44, 46 mounted fixedly in terms of rotation on an intermediate shaft 42 (FIGS. 3, 4 and 6).

To carry out a switching operation, the portable machine tool has a portable machine tool switching unit with a rotary knob unit 10 which has a rotationally drivable coupling unit 12, designed as an eccentric unit, for coupling to a switching element 14 designed as an adjusting slide (FIGS. 1, 2, 4 and 8 to 21). The coupling unit 12 has an output element 28 which is formed by an eccentric pin and which engages into a long hole 70 of the switching element 14 (FIGS. 4 and 8). The switching element 14 is formed by a flexural sheet metal part and engages by means of an integrally formed arm 48 between the two spur wheels of the double spur wheel 36. Furthermore, the portable machine tool switching unit has an energy accumulator element 16 which is formed by a leg spring and which is provided for the storage of switching energy in the event of preselection and is integrated in the rotary knob unit 10. The coupling unit 12, the energy accumulator element 16 and a grip unit 60 of the rotary knob unit 10 are parts of a common subassembly.

Figure 2:
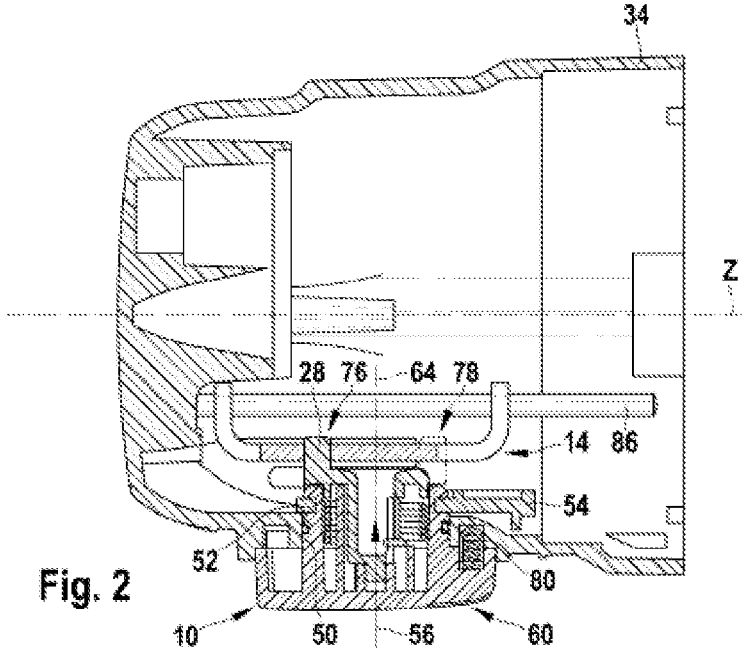
FIG. 2 shows a section along line II-II in FIG. 1.
Figure 3:
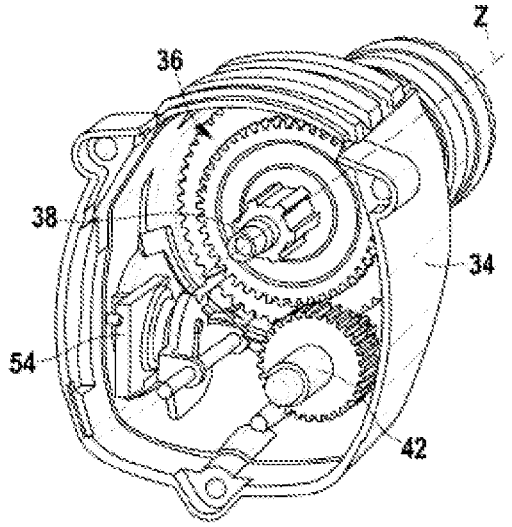
FIG. 3 shows a three-dimensional view into a transmission housing of the portable machine tool.
Figure 4:
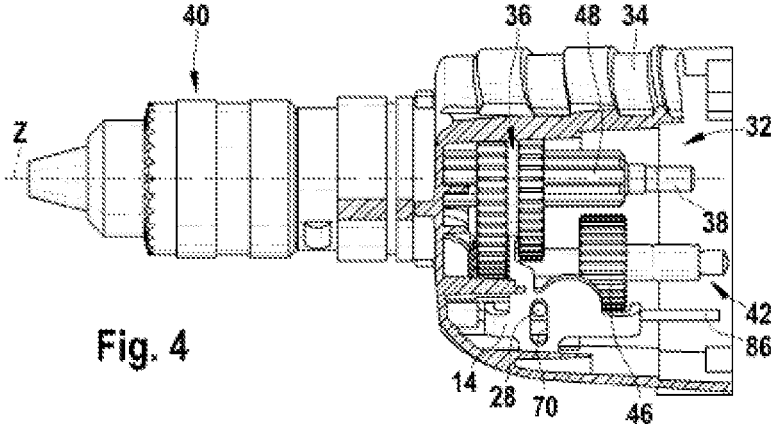
FIG. 4 shows a side view of the portable machine tool, with a transmission housing partially cut out.
Figure 5:
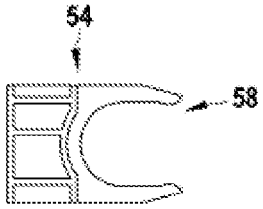
FIG. 5 shows a holding plate illustrated individually.

The rotary knob unit 10 is plugged into a recess 50 of the transmission housing 34 in a plug-in direction 56 and is secured, opposite to the plug-in direction 56, via a latching connection 52 in a holding plate 54 arranged in a transmission housing 34 (FIGS. 2, 3 and 5). For this purpose, the holding plate 54 has a U-shaped reception region 58 into which the rotary knob unit 10 is latched.

The energy accumulator element 16 or the leg spring is arranged in the force flux between a first rotationally drivable shaft 18 of the coupling unit 12 and a second rotationally drivable shaft 20 of the grip unit 60 of the rotary knob unit 10, the leg spring extending over a plurality of 360° about the rotationally drivable shafts 18, 20 (FIGS. 10, 11, 12, 15 to 21). The first shaft 18, designed as a hollow shaft, of the coupling unit 12 is arranged in the second shaft 20, likewise designed as a hollow shaft, of the grip unit 60 and is mounted rotatably in a bearing bush 74 of the grip unit 60 by means of an integrally formed bearing journal 72. The shafts 18, 20 have in each case a recess 22, 24 which extends in the circumferential direction of the shafts 18, 20 over an angular range 26 of approximately 110° (cf., in particular, FIG. 12). The shaft 18 is formed in one piece with the output element 28, designed as an eccentric pin, and with the bearing journal 72 (cf., in particular, FIGS. 17 to 21). The shaft 20 is formed in one piece with an output element of the grip unit 60, specifically with a grip element forming a gripping surface (cf., in particular, FIG. 11).

Figure 12:
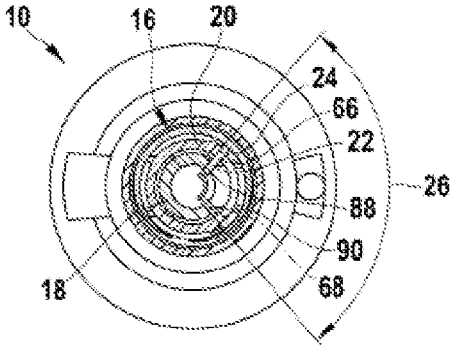
FIG. 12 shows a section along line XII-XII in FIG. 11.
Figure 13:
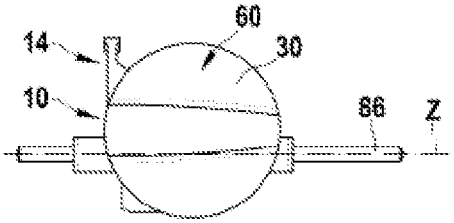
FIG. 13 shows a top view of the rotary knob unit with the adjusting slide and with a bearing axis.
Figure 14:
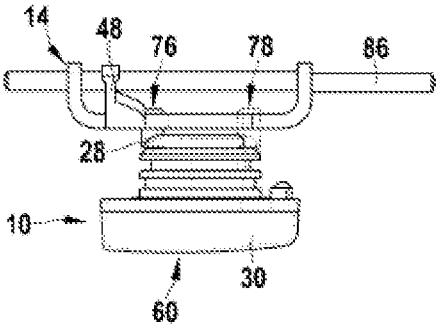
FIG. 14 shows the unit from FIG. 13 in a position rotated through 90° about a Z-axis.
Figure 15:
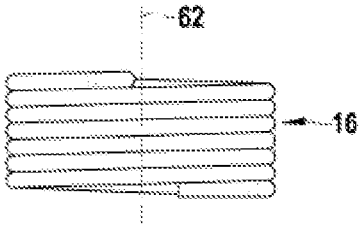
FIG. 15 shows a side view of an energy accumulator element formed by a leg spring.
Figure 16:
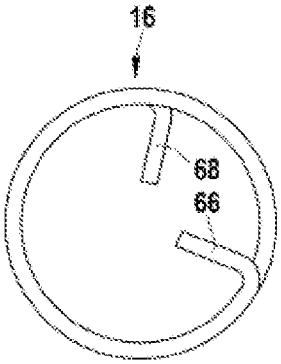
FIG. 16 shows the leg spring in a top view.
Figure 17:
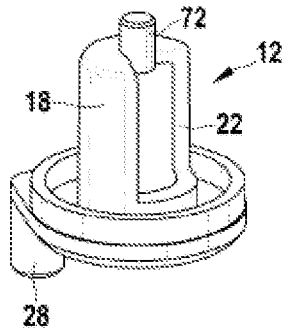
FIG. 17 shows a coupling unit of the rotary knob unit in a three-dimensional illustration.
Figure 18:
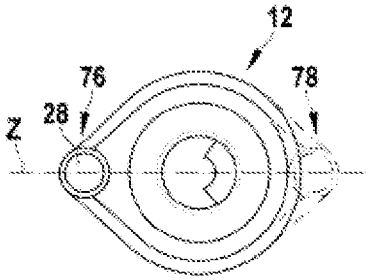
FIG. 18 shows the coupling unit in a first top view.
Figure 19:
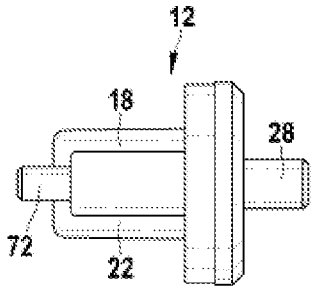
FIG. 19 shows the coupling unit in a first side view.
Figure 20:
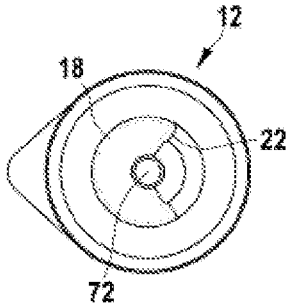
FIG. 20 shows the coupling in a second top view.
Figure 21:
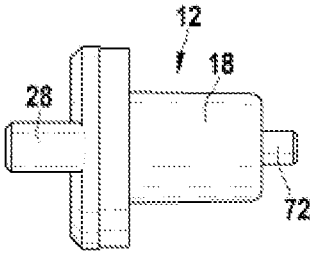
FIG. 21 shows the coupling unit in a second side view.

The leg spring is designed as a helical spring with a plurality of turns and, at a first end in the direction of a helical axis 62 the leg spring, which coincides essentially with an axis of rotation 64 of the rotary knob unit 10, has a first radially inward-projecting leg 66 and, at a second end in the direction of the helical axis 62, has a second radially inward-projecting leg 68 (FIGS. 2, 10, 11, 12, 15 and 16). In the assembled state, the legs 66, 68 project radially inward through the recess 24 of the shaft 20 into the recess 22 of the shaft 18 and bear, prestressed, against the margins of the shafts 18, 20, said margins delimiting the recesses 22, 24 (FIG. 12).

When the grip unit 60 is rotated by an operator from a first rotary position 82 or 84 into a second rotary position 84 or 82 through 180° about the axis of rotation to switch from one transmission gear to another transmission gear, and when there is no tooth-on-tooth position between the spur wheels to be switched, the eccentric pin of the coupling unit 12 is rotated into switching positions 76 or 78 and the switching element 14 mounted displaceably on a bearing axis 86 is displaced by means of the eccentric pin engaging into the long hole 70, and the transmission gear to be switched is switched (FIGS. 1, 2, 14 and 18). If a required switching force overshoots a force capable of being applied by the leg spring, the leg 66 or 68 cooperates, after an angled rotation of 110° of the angular range 26, with stops 88, 90 of the portable machine tool switching unit, parts of the leg spring being bridged in the force flux.

In the switching positions 76, 78, with the transmission gears switched, the eccentric pin is located in each case in a reversal position along a pulse axis Z along which a pulse of a percussion mechanism, not illustrated in any more detail, of the portable machine tool acts during operation upon an insertion tool inserted into the portable machine tool, with the result that the leg spring is decoupled from vibrations along the pulse axis Z. The leg spring is prestressed in the switching positions. The grip unit 60 is secured in the circumferential direction in the rotary positions 82, 84 by means of an integrated spring-mounted latching bolt 80, in that the latter is latched in recesses of the transmission housing 34 in the switching positions 76, 78.

When the grip unit 60 is rotated by an operator from the rotary position 82 or 84 into the other rotary position 84 or 82 through 180° about the axis of rotation 64 to switch from one transmission gear to another transmission gear, and when there is a tooth-on-tooth position between the spur wheels to be switched, the grip unit 60 and the coupling unit 12 and therefore also the shafts 18, 20 are rotated with respect to one another and the leg spring is prestressed further. When the tooth-on-tooth position is cancelled, the preselected transmission gear is switched by means of the tension energy stored in the leg spring, in that by means of the tension energy of the leg spring the coupling unit 12 or the eccentric pin is rotated into its switching position 76 or 78, the switching element 14 is displaced and the corresponding transmission gear is switched.

The invention claimed is:

1. A portable machine tool switching unit comprising:

a rotary knob unit including a first rotationally drivable shaft and a second rotationally drivable shaft that is coaxial with the first shaft relative to an axis of rotation and that is rotatable relative to the first shaft about the axis of rotation, the first shaft including a rotationally drivable coupling unit for coupling to at least one switching element and a bearing journal, the second shaft defining a cavity in which the first shaft and the bearing journal are located and including a bearing bush located in the cavity and configured to receive the bearing journal, the bearing bush and the bearing journal coaxial with the axis of rotation; and at least one energy accumulator element configured to store switching energy in the event of preselection, the energy accumulator element including a coil portion that is located outside of the cavity defined by the second shaft, such that the first shaft and the second shaft are located within a coil space defined by the coil portion, wherein the energy accumulator element is integrated in the rotary knob unit and engages the first and second shafts, and wherein the energy accumulator element further includes at least one inwardly-projecting leg extending from the coil portion toward the axis of rotation and configured to extend into the cavity defined by the second shaft and into a cavity defined by the first shaft.

2. The portable machine tool switching unit as claimed in claim 1, wherein the coil portion extends completely around the first shaft and the second shaft.

3. The portable machine tool switching unit as claimed in claim 1, wherein the energy accumulator element is arranged in the force flux between the first shaft and the second shaft.

4. The portable machine tool switching unit as claimed in claim 3, wherein the first shaft is formed in one piece with an output element of the coupling unit.

5. The portable machine tool switching unit as claimed in claim 1, wherein at least one of the shafts has a recess which extends in the circumferential direction of the at least one shaft over an angular range greater than 30° with the inwardly-projecting leg extending inside the recess.

6. The portable machine tool switching unit as claimed in claim 1, wherein the coil portion is prestressed in a switching position.

7. The portable machine tool switching unit as claimed in claim 1, wherein the coupling unit has at least one eccentric unit.

8. The portable machine tool switching unit as claimed in claim 1, further comprising:

at least one mechanical stop configured to drive the coupling unit.

9. The portable machine tool switching unit as claimed in claim 1, further comprising:

a spring-mounted latching bolt extending from the second shaft, wherein the rotary knob is rotatable to a first rotary position and to a second rotary position, and wherein the spring-mounted latching bolt is configured to releasably retain the rotary knob in a selected one of the first rotary position and the second rotary position.

10. A portable machine tool comprising:

a portable machine tool switching unit including (i) a rotary knob unit including a first rotationally drivable shaft and a second rotationally drivable shaft that is coaxial with the first shaft relative to an axis of rotation and that is rotatable relative to the first shaft about the axis of rotation, the first shaft including a rotationally drivable coupling unit for coupling to at least one switching element and a bearing journal, the second shaft defining a cavity in which the first shaft and the bearing journal are located and including a bearing bush located in the cavity and configured to receive the bearing journal, the bearing bush and the bearing journal coaxial with the axis of rotation, and (ii) at least one energy accumulator element configured to store switching energy in the event of preselection, the energy accumulator element including a coil portion that is located outside of the cavity defined by the second shaft, such that the first shaft and the second shaft are located within a coil space defined by the coil portion, wherein the energy accumulator element is integrated in the rotary knob unit and engages the first and second shafts, and wherein the energy accumulator element further includes at least one inwardly-projecting leg extending from the coil portion toward the axis of rotation and configured to extend into the cavity defined by the second shaft and into a cavity defined by the first shaft.

11. The portable machine tool as claimed in claim 10, further comprising a sliding gear transmission.

12. A portable machine tool switching unit comprising:

a rotary knob unit including a first rotationally drivable shaft and a second rotationally drivable shaft that is coaxial with the first shaft relative to an axis of rotation and that is rotatable relative to the first shaft about the axis of rotation, the first shaft including a rotationally drivable coupling unit configured to couple to at least one switching element and a bearing journal, the second shaft defining a cavity in which the first shaft and the bearing journal are located and including a bearing bush located in the cavity and configured to receive the bearing journal, the bearing bush and the bearing journal coaxial with the axis of rotation; and at least one energy accumulator element configured to store switching energy in response to a preselection, the at least one energy accumulator element integrated in the rotary knob unit and including a coil portion that is located outside of the cavity defined by the second shaft, such that the first shaft and the second shaft are located within a coil space defined by the coil portion, and the at least one energy accumulator element configured to engage the first and second shafts, wherein the energy accumulator element further includes at least one inwardly-projecting leg extending from the coil portion toward the axis of rotation and configured to extend into the cavity defined by the second shaft and into a cavity defined by the first shaft.

13. The portable machine tool switching unit as claimed in claim 12, wherein the coil portion extends completely around the first shaft and the second shaft.

14. The portable machine tool switching unit as claimed in claim 12, wherein the at least one energy accumulator element is arranged in a force flux between the first and the second shafts.

15. The portable machine tool switching unit as claimed in claim 14, wherein the first shaft is formed in one piece with an output element of the rotary knob unit.

16. The portable machine tool switching unit as claimed in claim 12, wherein the coil portion is prestressed in a switching position.

17. The portable machine tool switching unit as claimed in claim 12, wherein the coupling unit has at least one eccentric unit.

* * * * *